US009840857B2

(12) United States Patent
Perkins et al.

(10) Patent No.: US 9,840,857 B2
(45) Date of Patent: Dec. 12, 2017

(54) VEHICLE DOOR LATCH

(75) Inventors: Donald M. Perkins, Sterling Heights, MI (US); Francisco J. Lujan, Juarez (MX); Carlos I. Tostado, Juarez (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 157 days.

(21) Appl. No.: 12/633,487

(22) Filed: Dec. 8, 2009

(65) Prior Publication Data

US 2011/0133493 A1 Jun. 9, 2011

(51) Int. Cl.

| | |
|---|---|
| ***E05C 3/06*** | (2006.01) |
| ***E05B 77/38*** | (2014.01) |
| ***E05B 85/26*** | (2014.01) |

(52) U.S. Cl.

CPC ..... *E05B 77/38* (2013.01); *E05B 85/26* (2013.01); *Y10T 292/1047* (2015.04)

(58) Field of Classification Search

CPC . E05C 3/14; E05B 85/26; E05B 83/16; E05B 53/003; Y10T 292/1047

USPC ..... 292/194, 214, 215, 216, 201, DIG. 23, 292/195, 1, 336.3, DIG. 56, DIG. 73

See application file for complete search history.

(56) References Cited

U.S. PATENT DOCUMENTS 4,892,339 A 1/1990 Kleefeldt et al.
4,969,673 A 11/1990 Portelli et al.
5,277,461 A 1/1994 Dzurko et al.
5,308,128 A * 5/1994 Portelli ..... E05B 77/265 292/216
5,316,354 A * 5/1994 Arabia, Jr. ..... E05B 85/045 292/340
5,454,608 A * 10/1995 Dzurko ..... E05B 81/90 292/216
5,520,426 A 5/1996 Arabia, Jr. et al.
5,535,607 A 7/1996 Dzurko et al.
5,584,515 A * 12/1996 Silye ..... E05B 81/06 292/201
5,632,517 A * 5/1997 Paulik ..... E05B 77/40 292/341.12

(Continued)

FOREIGN PATENT DOCUMENTS

EP 1195487 A2 4/2002
KR 1020070116795 12/2007

OTHER PUBLICATIONS

International Search Report dated Aug. 11, 2011; International Application No. PCT/US2010/059276.

(Continued)

*Primary Examiner* — Nathan Cumar
(74) *Attorney, Agent, or Firm* — Cantor Colburn LLP

(57) ABSTRACT

A vehicle door latch assembly is provided, the latch assembly having: a fork bolt movably secured to the latch assembly, the fork bolt being capable of movement between a latched position and an unlatched position; a detent lever movably secured to the latch assembly, the detent lever being capable of movement between an engaged position and a disengaged position, the detent lever retains the fork bolt in the latched position when the detent lever is in the engaged position and a engagement surface of the detent lever contacts an engagement surface of the fork bolt; and a spring member integrally formed with the detent lever, the spring member being deflected by a bumper secured to the latch assembly when the detent lever is moved to the engaged position.

18 Claims, 3 Drawing Sheets

(56) References Cited

U.S. PATENT DOCUMENTS

| | | | | |
|---|---|---|---|---|
| 5,715,713 | A | 2/1998 | Aubry et al. | |
| 6,053,542 | A * | 4/2000 | Ostrowski | E05B 81/20 292/201 |
| 6,264,253 | B1 * | 7/2001 | Takaishi | E05B 85/26 292/201 |
| 6,435,575 | B1 * | 8/2002 | Pajak | E05B 81/14 292/201 |
| 6,733,052 | B2 * | 5/2004 | Perkins | E05B 81/06 267/153 |
| 6,749,234 | B2 * | 6/2004 | Bruce | E05B 85/26 292/216 |
| 6,811,193 | B2 | 11/2004 | Arabia, Jr. et al. | |
| 7,090,264 | B2 | 8/2006 | Dzurko et al. | |
| 2009/0199605 | A1 | 8/2009 | Spurr et al. | |

OTHER PUBLICATIONS

Written Opinion dated Aug. 11, 2011; International Application No. PCT/US2010/059276.

* cited by examiner

VEHICLE DOOR LATCH

BACKGROUND

Exemplary embodiments of the present invention relate to door and movable panel latches and, more particularly, to door and movable panel latches for vehicles.

A vehicle frequently includes displaceable panels such as doors, hood, trunk lid, hatch and the like which are affixed for hinged or sliding engagement with a host vehicle body. Cooperating systems of latches and strikers are typically provided to ensure that such panels remain secured in their fully closed position when the panel is closed.

A door latch typically includes a forkbolt that is pivoted between an unlatched position and a primary latched position when the door is closed to latch the door in the closed position. The forkbolt is typically held in the primary latched position by a detent lever that pivots between an engaged position and a disengaged position. The detent lever holds the forkbolt in the primary latched position when in the engaged position and releases the forkbolt when in the disengaged position so that the door can be opened.

The forkbolt is pivoted to the primary latched position by a striker attached to, for example, an associated door jamb when the door is closed. Once in the primary latched position, the detent lever engages the forkbolt to ensure the assembly remains latched.

Latch sound quality can enhance or detract from the overall perception of quality by an end user about the construction of a vehicle. Good sound quality implies that the audible sounds shall convey solid construction, smooth operation, and thoughtfulness of design. The latch contributes to the abatement of noise and vibration, therefore, vehicle manufacturers are placing more emphasis on the ability of the door latch to absorb the noise emissions that may occur during a door closing event. Conventional door design places the door latch within the door cavity, and a striker mounted to the b-pillar of a vehicle. When the vehicle door is closed, the door latch first contacts the striker through the forkbolt lever, rotating it to a closed position. When rotated to this closed position, a second lever, the detent lever, rotates into position impeding the anti-rotation of the forkbolt, thus latching the door. These two levers are usually sandwiched between a steel structural frame plate and a plastic housing, and each pivot upon their respective steel pivots which are held fixed to the steel frame plate. During the latching event, the striker also contacts the striker guide usually integrated into the latch housing, and then the striker over-slam bumper, both of which serve to decelerate and dampen the kinetic energy of the swinging door.

Furthermore, the detent lever, which controls the position of the forkbolt lever, is spring loaded such that it will always return to a latched position. This spring torque creates a noise source due to the need of a stop to define a lever stop position.

Accordingly, it is desirable to provide a vehicle latch assembly that specifically address the aforementioned noise dampening methods in a unique manner that is superior to existing door latch designs.

SUMMARY OF THE INVENTION

In accordance with an exemplary embodiment of the invention, a vehicle latch assembly is provided. The latch assembly having: a fork bolt movably secured to the latch assembly, the fork bolt being capable of movement between a latched position and an unlatched position; a detent lever movably secured to the latch assembly, the detent lever being capable of movement between an engaged position and a disengaged position, the detent lever retains the fork bolt in the latched position when the detent lever is in the engaged position and a engagement surface of the detent lever contacts an engagement surface of the fork bolt; and a spring member integrally formed with the detent lever, the spring member being deflected by a bumper secured to the latch assembly when the detent lever is moved to the engaged position.

In accordance with another exemplary embodiment of the present invention, a method for absorbing stopping forces in a latch assembly, the method comprising: pivotally securing a forkbolt to the latch assembly for movement in a first plane between an unlatched position and a latched position; pivotally securing a detent lever to the latch assembly for movement in the first plane between an engaged position and a disengaged position wherein a contact surface of the detent lever engages a contact surface of the forkbolt when the detent lever is in the engaged position and the forkbolt is in the latched position; and adsorbing a stopping force of the detent lever by integrally molding a spring member to a surface of the detent lever, the spring member being capable of being deflected when the detent lever is in the engaged position and the spring member contacts a bumper secured to the latch assembly.

Additional features and advantages of the various aspects of exemplary embodiments of the present invention will become more readily apparent from the following detailed description in conjunction with the drawings wherein like reference numerals refer to corresponding parts in the several views.

Figure 1:
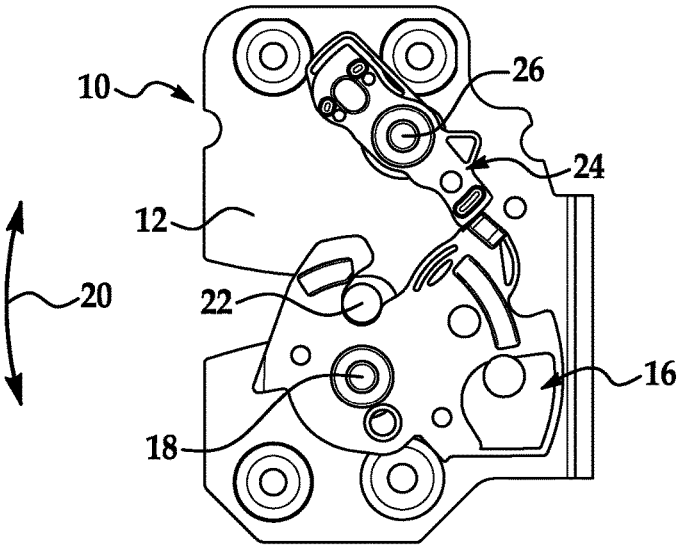
FIG. 1 is a view illustrating a latch assembly in a closed or primary latched position in accordance with an exemplary embodiment of the present invention.
Figure 2:
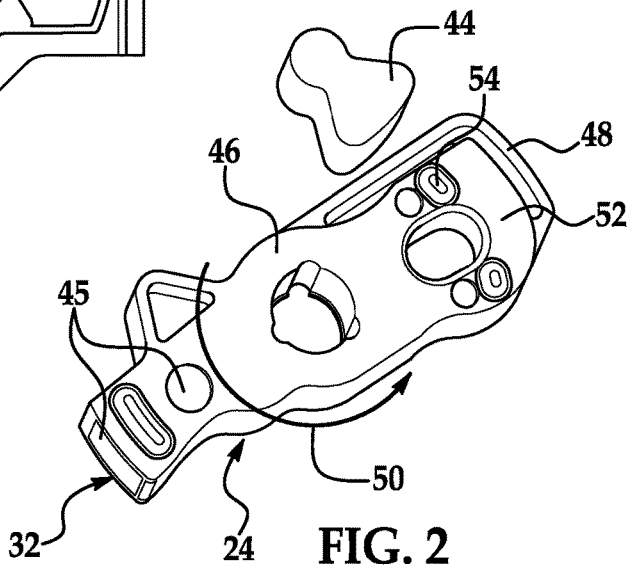
FIGS. 2 and 3 are views illustrating an exemplary embodiment of the present invention and movement of the detent lever of the latch assembly.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION OF EXEMPLARY EMBODIMENTS

Exemplary embodiments of the present invention relate to an apparatus and method for providing a latch assembly. Furthermore, exemplary embodiments are directed to a latch assembly having a forkbolt or forkbolt lever movably secured thereto for movement between a latched position and an unlatched position. The latch assembly further comprises a detent lever capable of movement between an engaged position and a disengaged position, wherein the detent lever retains the forkbolt in the latched position when the detent lever is in the engaged position.

In accordance with an exemplary embodiment of the present invention the detent lever of the latch assembly is provided with a spring member integrally formed with the detent lever, the spring member being deflected by a bumper secured to the latch assembly when the detent lever is moved to the engaged position. The spring member being capable of being deflected or deformed to adsorb or dampen a stopping force of the detent lever contacting the bumper such that the latch sound quality is improved in that abatement of noise and vibration is achieved through the deflection of the spring member.

In addition and in another embodiment, the forkbolt or forkbolt lever is also provided with a feature that adsorbs/dampens the stopping or closing forces of the forkbolt when it is transitioning into the closed position from the open position. Here the stopping forces are adsorbed by a feature located on a surface of the forkbolt that contacts an anti-bypass member such that the latch sound quality is improved in that abatement of noise and vibration is achieved through the braking forces applied by the feature contacting the ant-bypass member.

In addition, the distance between the feature of the forkbolt and a pivot point of the forkbolt is maximized such that a maximum stopping or braking force is applied thus further reducing noises associated with the closing forces.

Reference is made the following U.S. Pat. Nos. 6,811,193; 7,090,264; 5,520,426; 5,277,461; 5,316,354; 5,454,608; 4,969,673; 5,715,713; 5,535,607; 6,264,253; 6,749,234; and 6,733,052 the contents each of which are incorporated herein by reference thereto.

Referring now to FIGS. 1-8, a vehicle compartment latch or latch assembly 10 in accordance with an exemplary embodiment of the present invention is illustrated. In one embodiment, vehicle compartment latch 10 comprises a frame plate or support 12 that is adapted for fastening to a vehicle proximate to a compartment closure.

A forkbolt or forkbolt lever 16 is pivotally or rotationally mounted to frame plate 12 about a pivot pin or stud 18 that is received within a pivot pin opening of the forkbolt. Forkbolt 16 is capable of rotational or pivotal movement between an open or unlatched position and a closed or latched position shown in FIGS. 1, 6 and 8, wherein the forkbolt rotates in the direction of arrows 20.

Vehicle compartment latch 10 is attached to a vehicle structure such that forkbolt 16 is moved between the open position and the closed position when a door, window, lift gate, etc. is opened and closed and forkbolt 16 engages a striker 22 (illustrated in cross section) that is attached to the door, window, lift gate, etc. Alternatively, the vehicle compartment latch 10 is secured to the door, window, lift gate, etc. and the striker is secured to the vehicle body at an opening into which the door, window, lift gate, etc. is received. The cooperation of a forkbolt and striker is well known and need not be described in detail.

Vehicle compartment latch 10 further comprises a detent lever 24 that pivots on support or frame plate 12 about a pivot pin 26 received within a pivot pin opening in the detent lever. The detent lever cooperates with forkbolt 16 in a well known manner to retain forkbolt 16 in the closed position shown in the FIGS. or release the forkbolt 16 for return to the open position. That is, detent lever 24 pivots between a closed or engaged detent position shown in the FIGS. and a release or disengaged detent position in the direction of arrows 28. In accordance with an exemplary embodiment of the present invention, forkbolt 16 is spring biased to the open position by a biasing member (e.g., coil spring or other equivalent member) that has one end attached to forkbolt 16 and the other end attached to the housing or other equivalent location. Similarly, a biasing member or spring will also bias the detent lever in the direction of a face of forkbolt 16.

In accordance with exemplary embodiments of the present invention, the forkbolt has an engagement surface or contact surface 30 that slides along and makes contact with a complimentary engagement surface or contact surface 32 of the detent lever when the forkbolt pivots or moves from the open position to the closed position and once in the closed position surface 30 of the forkbolt engages a surface 32 of the detent lever thus engaging the forkbolt and securing it into the closed position when the striker is secured in a receiving opening 38 of the forkbolt. Once the latch is in the closed position the detent lever is spring biased into contact with the forkbolt such that the forkbolt cannot rotate into the open position unless the detent lever is moved back to the release or disengaged detent position (e.g., moving surface 30 away from surface 32 allowing the forkbolt to rotate into the open position).

Figure 8:
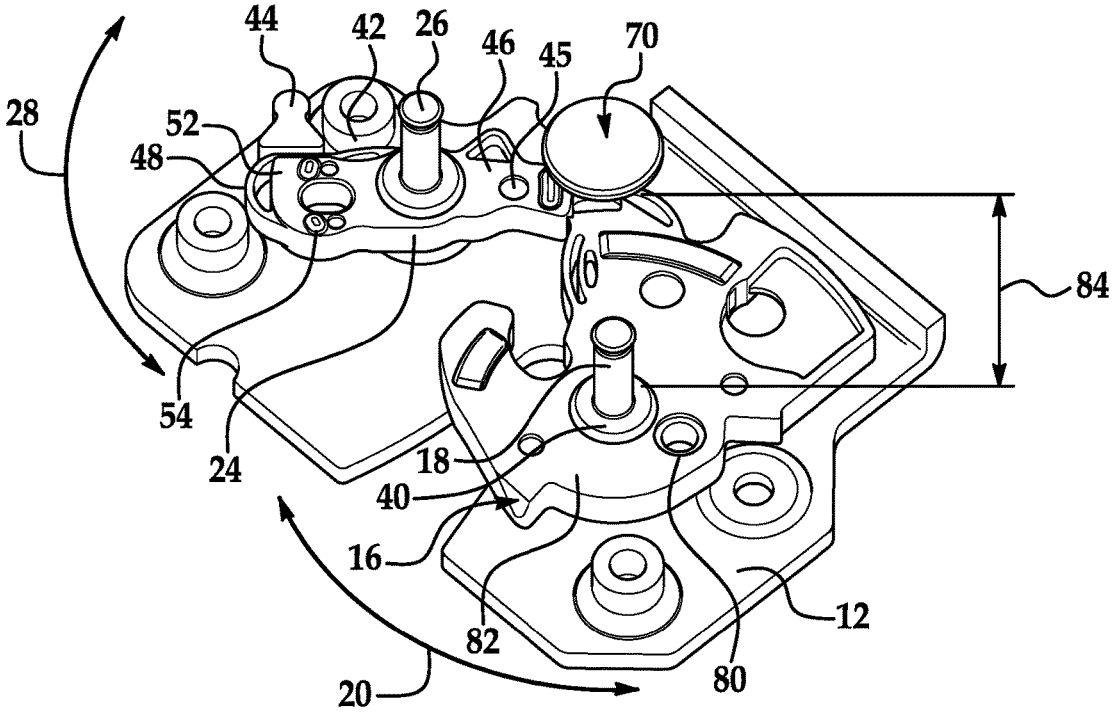
FIG. 8 is a perspective view of an exemplary embodiment of the present invention.

FIGS. 1 and 8 show structural components of a latch in a fully latched orientation. As seen, the detent lever is engaged on the primary tooth of the forkbolt lever, and each lever is capable of rotating about its respective pivot stud. The pivot studs are held mechanically fixed to the frame plate thus trapping their respective levers between the frame plate and a formed flange 40, 42 of the pivot studs. The pivot studs are dual supported opposite the frame plate by a back plate (not shown).

Figure 3:
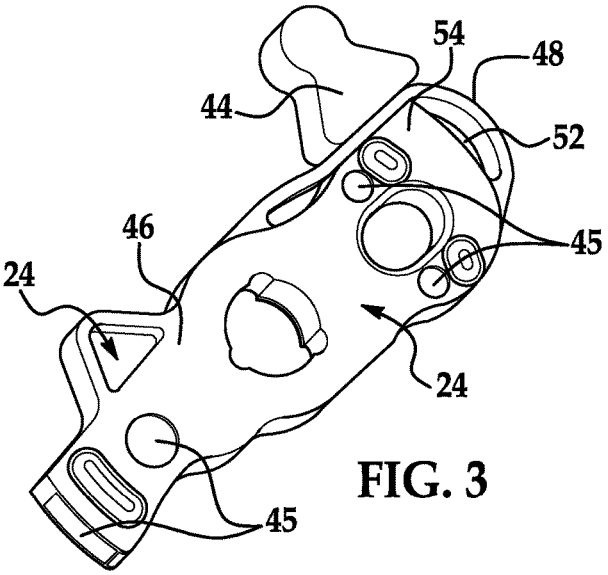
Figure 4:
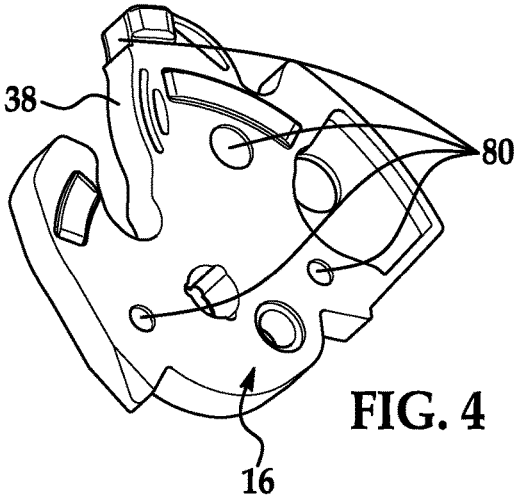
FIGS. 4 and 5 are perspective views of a forkbolt in accordance with an exemplary embodiment of the present invention.
Figure 5:
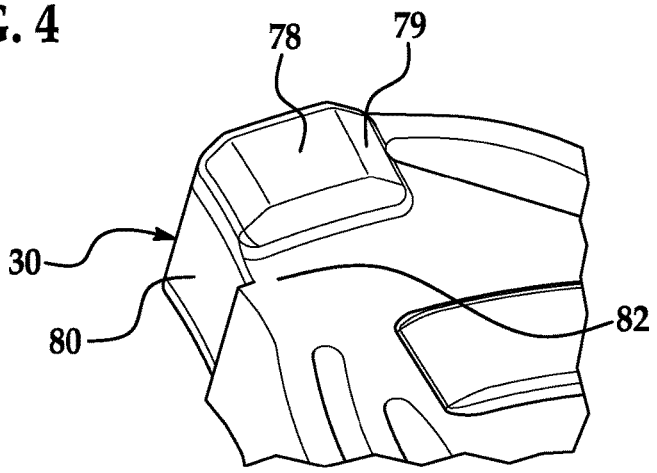

In accordance with an exemplary embodiment of the present invention, the detent lever makes contact with a bumper 44 when the detent lever is in the latched position see at least FIGS. 3 and 8. In one embodiment, the detent lever subassembly, see at least FIGS. 2 and 3, consists of a steel component 45 partially viewable at least at surface 32, encapsulated with a thermoplastic elastomer or other equivalent material 46. Integrated into the encapsulation of elastomer 46 is a flexible web feature or spring 48. This flexible web feature assists in the deceleration of the detent lever when it returns via spring torque illustrated by arrow 50 to its latched position. As the detent lever reaches its stop position (e.g., contacting the bumper) the aforementioned web feature deforms until it reaches the maximum compression surface (FIG. 3) which controls the latched position of the detent lever. In addition to the web feature integrated into the detent lever encapsulation, the detent lever return stop noise dampening is further enhanced by the elastomeric bumper 44, which acts in series with the web feature. It is the combination of the two features that results in optimal noise suppression of the detent lever return stop sound.

As illustrated and in one embodiment, the integral web feature or spring is located at one end of the detent lever while the contact surface 32 is located at an opposite end. Of course, numerous other configurations are contemplated in order to provide for maximum noise suppression.

In one embodiment the bumper is secured to the frame plate and comprises an elastomeric coating or other equivalent material while the detent lever is formed from steel or any other suitable material and is coated with a thermoplastic elastomer such that the flexible web or integrally formed spring 48 is provided. As illustrated, the flexible web feature is spaced away from at least two peripheral surfaces 52, 54 of the encapsulated detent lever and the flexible web is capable of deforming or deflecting towards at least one of the surfaces when the web makes contact with the bumper 44. It is, of course, understood that the elastomer or material comprising spring 48 can be spaced from only one or more than one (e.g., two, three or more) peripheral surfaces of the encapsulated detent lever and the elastomer or material comprising spring 48 will have resilient characteristics allowing it to deform and spring back to its un-deformed configuration in order to provide the desired dampening and noise abatement features. Although a specific configuration is illustrated and described, exemplary embodiments contemplate numerous configurations and the embodiments of the present invention are not intended to be limited to the specific configurations illustrated and described herein.

Figure 6:
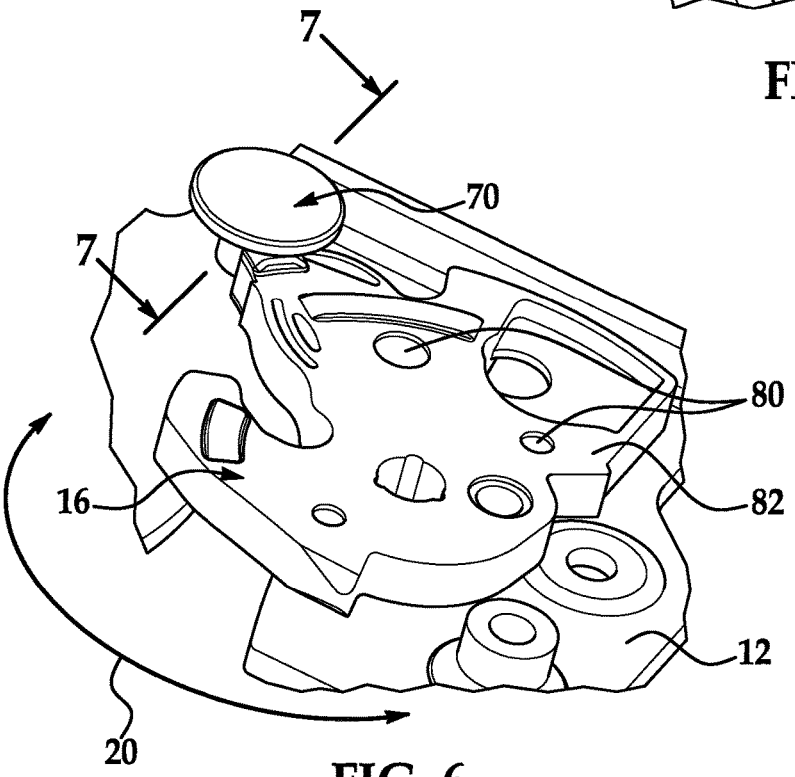
FIG. 6 is a perspective view of a portion of a latch assembly in accordance with an exemplary embodiment of the present invention.
Figure 7:
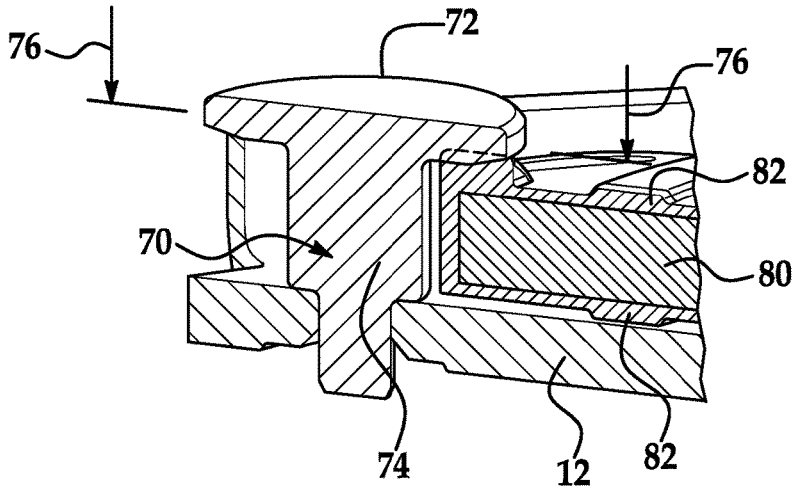
FIG. 7 is a view along lines 7-7 of FIG. 6.

FIGS. 1 and 8 illustrate a preferred planar relationship between the forkbolt and the detent lever and a bite surface interface. In accordance with an exemplary embodiment, FIGS. 6-8 illustrate a feature referred to as an anti-bypass member or an anti-bypass rivet 70. As illustrated in FIGS. 6-8, the anti-bypass rivet comprises a steel member or any other suitable material is secured to the latch assembly by any suitable process (e.g., press fitting, welding, etc.) and is located in such a manner so as to not impede the rotation of the forkbolt and the detent lever under normal operation.

However, the anti-bypass member or an anti-bypass rivet prevents unwanted movement of the forkbolt and/or the detent lever. In order to do this the anti-bypass member or anti-bypass rivet has a head portion 72 that depends outwardly from a shaft portion 74 of the anti-bypass member or anti-bypass rivet. Furthermore, the head portion of the anti-bypass member or anti-bypass rivet is located and large enough to cover the bite surface interface of the forkbolt and detent lever.

In addition, the head portion of the anti-bypass member or anti-bypass rivet is located in a plane or second plane 76 that is parallel to a plane or first plane that the forkbolt and the detent lever rotate in. Accordingly, the anti-bypass member or anti-bypass rivet will allow for rotational movement of the forkbolt and the detent lever however, if their movement begins to move out of the plane they rotate in, the detent lever or the forkbolt or both with contact the anti-bypass member or anti-bypass rivet and preventing a by-pass condition wherein the forkbolt transitions to the open position when the detent lever is in the engaged position.

In addition, optimal overall door closing sound quality is further enhanced via an integrated braking feature 78 located on a surface of the forkbolt lever. The forkbolt lever subassembly, FIGS. 4-8, comprises of a steel component 80 that is encapsulated with a thermoplastic elastomer or other equivalent material 82. Integrated into the encapsulation is a wedge feature 78. As illustrated, wedge feature 78 is protrusion or other feature extending from component 80. In one non-limiting embodiment, the feature has at least one inclined surface 79 for engaging the head member of the anti-bypass rivet or member. In other alternative embodiments, the feature can be configured to have multiple inclined surfaces some of which are located on opposite sides of the feature or in still another embodiment, the feature may be configured to not have any inclined surfaces. The effect of this feature is a rapid deceleration of the striker via the forkbolt/rivet head interface just prior to the forkbolt achieving its latched position. This rapid deceleration minimizes any oscillations the system may experience during closing and/or opening. This deceleration is accomplished by forcing the wedge feature under the flange 72 of the by-pass rivet that has been mechanically fastened to the frame of the latch assembly (further depicted in FIG. 7 (cross section view)). The location of this rivet at the bite surface of the forkbolt and the detent lever allows for placement of the wedge feature to be at a maximum radial distance 84 from the pivot point of the forkbolt lever which provides maximum braking efficiency.

Accordingly, the condition created by the forkbolt lever wedging between two fixed surfaces and the web feature in series with the stop bumper at the detent lever makes this design exhibit superior door closing sound noise suppression.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A vehicle door latch assembly, comprising:

a fork bolt movably secured to the latch assembly for movement between a latched position and an unlatched position;

a detent lever movably secured to the latch assembly for movement between an engaged position and a disengaged position, the detent lever retains the fork bolt in the latched position when the detent lever is in the engaged position and an engagement surface of the detent lever contacts an engagement surface of the fork bolt; and an L shaped spring member integrally formed with a component of the detent lever, the spring member having a contact portion that is in a facing spaced relationship with respect to two peripheral edge surfaces of the component of the detent lever that is at least partially covered by the spring member and, the two peripheral edge surfaces are adjacent to each other and extend from one side of the component of detent lever to another opposite side of the component of the detent lever such that the contact portion of the spring member is parallel to and in a facing spaced relationship with respect to the two peripheral edge surfaces of the component of the detent lever when the detent lever is in the disengaged position, wherein the contact portion of the spring member is deflected by a bumper secured to the latch assembly when the detent lever is moved to the engaged position such that a portion of contact portion of the spring member contacts at least one of the peripheral edge surfaces, and wherein one of the two peripheral edge surfaces is located at a distal end of the component of the detent lever and an opposite distal end of the component of the detent lever has the engagement surface that contacts the engagement surface of the fork bolt when the detent lever is in the engaged position and wherein the detent lever is movably mounted to the latch assembly via a pivot pin located between the distal ends of the detent lever.

2. The vehicle door latch assembly as in claim 1, wherein a feature is disposed on and extends away from a surface of the fork bolt, the feature being configured to engage an anti-bypass member secured to the latch assembly, the anti-bypass member being configured to prevent the engagement surface of the detent lever from being deflected away from the engagement surface of the fork bolt when the detent lever is in the engaged position and the fork bolt is in the latched position such that the fork bolt would be able to move to the unlatched position when the detent lever is in the engaged position.

3. The vehicle door latch assembly as in claim 2, wherein the feature is formed from an elastomer applied to a surface of the fork bolt.

4. The vehicle door latch assembly as in claim 2, wherein the feature is located at a maximum distance from a pivot point of the forkbolt while still being located on an exterior surface of the fork bolt.

5. The vehicle door latch assembly as in claim 4, wherein the feature is formed from an elastomer applied to a surface of the fork bolt.

6. The vehicle door latch assembly as in claim 2, wherein the anti-bypass member is a rivet secured to the vehicle door latch assembly.

7. The vehicle door latch assembly as in claim 6, wherein the rivet is secured a frame plate of the vehicle door latch assembly and the fork bolt and the detent lever are movably secured to the frame plate.

8. The vehicle door latch assembly as in claim 7, wherein the rivet further comprises a shaft portion and a head member, the head member being disposed over the engagement surface of the detent lever and the engagement surface of the fork bolt and the feature engages the head member when the fork bolt is moved into the latched position.

9. The vehicle door latch assembly as in claim 1, wherein the spring member is formed from an elastomer applied to a surface of the component of the detent lever and wherein the bumper is an elastomeric bumper.

10. The vehicle door latch assembly as in claim 9, wherein the component is formed from steel.

11. The vehicle door latch assembly as in claim 9, wherein a feature is disposed on and extends away from a surface of the fork bolt, the feature being configured to engage an anti-bypass member secured to the latch assembly, the anti-bypass member having a head member configured to prevent the engagement surface of the detent lever from being deflected away from the engagement surface of the fork bolt when the detent lever is in the engaged position and the fork bolt is in the latched position such that the fork bolt would be able to move to the unlatched position when the detent lever is in the engaged position.

12. The vehicle door latch assembly as in claim 11, wherein the feature is an inclined surface.

13. The vehicle door latch assembly as in claim 2, wherein the anti-bypass member is a rivet secured to a frame plate of the vehicle door latch assembly and the forkbolt and the detent lever are movably secured to the frame plate for pivotal movement in a first plane and wherein the rivet has a shaft portion and a head portion depending outwardly from the shaft portion, the shaft portion being secured to the frame plate and wherein the head member is disposed in a second plane, the second plane being spaced from the first plane to allow for pivotal movement of the forkbolt and the detent lever and the head member is disposed over the engagement surface of the detent lever and the engagement surface of the forkbolt and wherein the first plane is parallel to the second plane.

14. A method for absorbing stopping forces in a latch assembly, the method comprising:

pivotally securing a forkbolt to the latch assembly for movement in a first plane between an unlatched position and a latched position;

pivotally securing a detent lever to the latch assembly for movement in the first plane between an engaged position and a disengaged position wherein a contact surface of the detent lever engages a contact surface of the forkbolt when the detent lever is in the engaged position and the forkbolt is in the latched position; and adsorbing a stopping force of the detent lever by integrally molding an L shaped spring member to a component of the detent lever such that the spring member has a contact portion that is in a facing spaced relationship with respect to two peripheral edge surfaces of the component of the detent lever that are adjacent to each other and the two peripheral edge surfaces extend from one side of the component of the detent lever to another opposite side of the component of the detent lever, the contact portion of the spring member being deflected into contact with one of the two peripheral edge surfaces when the detent lever is in the engaged position and the spring member contacts an elastomeric bumper secured to the latch assembly and wherein the contact portion of the spring member is parallel to and in a facing spaced relationship with respect to the two peripheral edge surfaces when the detent lever is in the disengaged position, wherein one of the two peripheral edge surfaces is located at a distal end of the component of the detent lever and an opposite distal end of the component of the detent lever has the engagement surface that contacts the engagement surface of the fork bolt when the detent lever is in the engaged position and wherein the detent lever is movably mounted to the latch assembly via a pivot pin located between the distal ends of the detent lever.

15. The method as in claim 14, further comprising:

adsorbing a stopping force of the forkbolt by locating a feature on a surface of the fork bolt, the feature extending away from the surface and is configured to engage an anti-bypass member secured to the latch assembly, the anti-bypass member being configured to prevent the engagement surface of the detent lever from being deflected away from the engagement surface of the fork bolt when the detent lever is in the engaged position and the fork bolt is in the latched position such that the fork bolt would be able to move to the unlatched position when the detent lever is in the engaged position.

16. The method as in claim 15, wherein the anti-bypass member is a rivet secured to the vehicle door latch assembly, the rivet having a shaft portion and a head portion depending outwardly from the shaft portion and wherein the rivet is secured to a frame plate of the vehicle door latch assembly and the forkbolt and the detent lever are movably secured to the frame plate for pivotal movement in a first plane and the head member is disposed in a second plane, the second plane being spaced from the first plane to allow for pivotal movement of the forkbolt and the detent lever and the head member is disposed over the engagement surface of the detent lever and the engagement surface of the forkbolt, the first plane being parallel to the second plane.

17. The method as in claim 15, wherein the feature is located at a maximum distance from a pivot point of the forkbolt while still being located on an exterior surface of the fork bolt and wherein the feature is formed from an elastomer applied to the fork bolt.

18. The method as in claim 14, wherein the spring member is formed from an elastomer applied to a surface of the component of the detent lever.

* * * * *